US006055910A

United States Patent [19]

Zanakis et al.

[11] Patent Number: 6,055,910

[45] Date of Patent: May 2, 2000

[54] TOY GAS FIRED MISSILE AND LAUNCHER ASSEMBLY

[76] Inventors: Michael F. Zanakis, 8 Birch La., Morristown, N.J. 07960; Philip A. Femano, 2 Alexander Ave., Nutley, N.J. 07110

[21] Appl. No.: 09/088,006

[22] Filed: Jun. 1, 1998

[51] Int. Cl.[7] ..... F42B 4/06

[52] U.S. Cl. ..... 102/347; 102/351

[58] Field of Search ..... 102/353, 355, 102/502; 89/7; 42/55, 54; 446/399, 400, 401

[56] References Cited

U.S. PATENT DOCUMENTS

| | | | |
|---|---|---|---|
| 1,285,287 | 11/1918 | McDaniel | 446/400 |
| 3,745,691 | 7/1973 | Brown, Jr. | 446/399 |
| 3,938,272 | 2/1976 | Ditto et al. | 89/7 X |
| 5,303,496 | 4/1994 | Kowalkowski | 42/54 X |
| 5,361,700 | 11/1994 | Carbone | 102/502 X |
| 5,608,179 | 3/1997 | Voecks et al. | 89/7 X |
| 5,771,621 | 6/1998 | Rogers | 42/55 |
| 5,887,578 | 3/1999 | Backeris et al. | 42/55 X |

*Primary Examiner*—Charles T. Jordan
*Assistant Examiner*—Denise J Buckley
*Attorney, Agent, or Firm*—Hopgood, Calimafde Kalil & Judlowe

[57] ABSTRACT

A toy gas-fired missile and launcher assembly whose missile is composed of a soft head and a tail extending therefrom formed by a piston. The piston is telescoped into the barrel of a launcher having a closed end on which is mounted an electrically-activated ignitor, the air space between the end of the piston and the closed end of the barrel defining a combustion chamber. Joined to the barrel and communicating with the chamber therein is a gas intake tube having a normally-closed inlet valve. To operate the assembly, the operator places the inlet tube with its valve open adjacent his anal region from which a colonic gas is discharged. The piston is then withdrawn to a degree producing a negative pressure to inhale the gas into the combustion chamber to intermix with the air therein to create a combustible mixture. The ignitor is then activated to explode the mixture in the chamber and fire the missile into space.

9 Claims, 1 Drawing Sheet

TOY GAS FIRED MISSILE AND LAUNCHER ASSEMBLY

BACKGROUND OF INVENTION

1. Field of Invention

This invention relates generally to toy gas-fired missiles, and more particularly to a toy gas-fired missile and launcher assembly in which the explosive mixture for propelling the missile is derived from colonic gas discharged by the operator of the toy.

2. Status of Prior Art

Flatulence is the accumulation of excessive gas in the stomach or intestine. Because flatulence may be socially embarrassing, it is one of the most common complaints encountered in medical practice. Although a number of factors have been implicated in its pathogenesis, sometimes no cause can be found and it may therefore prove refractory to treatment. Thus, serious discussions of flatulence have led to little more than home remedies, largely empirically derived. Only in the last three decades has there emerged a science of flatology (Price, et al., 1988; Danzl, 1992).

A number of variables determine the volume, composition and frequency of flatus (Fardy and Sullivan, 1988). These include age, heredity, stress, diet and antibiotics. Normal individuals eating a typical diet produce 400 to 1,600 ml of flatus per day (Levitt, 1971). The composition of flatus varies dramatically among individuals. Five simple odorless gases are their major components. In order of decreasing prevalence in normal individuals, these are nitrogen, hydrogen, carbon dioxide, methane and oxygen (Van Ness and Cattau, 1985).

The odor associated with flatus is due to hydrogen sulfide, skatole, indole, volatile amines and short-chain fatty acids. These substances are detectable by olfactory neurons in concentrations as low as 10 parts per billion (Levitt and Bond, 1970, Boucher, 1980).

There are four mechanisms of intestinal gas production. The least significant contributor of intestinal gas volume is the diffusion of gas from tissues and vasculature to the bowel. Under normal conditions, this constitutes only a few percent of the total volume, and the primary component is carbon dioxide (Danhof, 1968). Another more minor component of gas production is from the acidification of bicarbonate in intestinal secretions. The primary gas produced in this manner is also carbon dioxide, most of which is absorbed in the upper gut (Bouchier, 1980). Aerophagia can be a major source of intestinal gas. The percentage of nitrogen in flatus increases with air swallowing (Rider and Moeller, 1960), and postprandial bloating secondary to air swallowing is exacerbated by fat indigestion, which delays gastric emptying (Polish and Kadish, 1968; Van Ness and Cattau, 1985).

The least understood mechanism of intestinal gas production is that from bacterial fermentation in the colon (Friedman, 1991). Fermentation of indigestible polysaccharides by colonic bacteria results in dramatic increases in hydrogen production and flatus passage. In legumes, for example, raffinose and stachyose have been implicated as the major oligosaccharides that provide the substrate for colonic bacteria. Cellulose, which is the main component of the tough outer coating of beans, also is nondigestible and provides a similar substrate (Van Ness and Cattau, 1985).

Aside from occasional caveats found in textbooks concerning the dangers of electrocautery and the subsequent explosion of the colon during surgery (Levitt and Bond, 1978), or anecdotal accounts of flatus ignition, there is little scientific discourse on the combustive properties of flatus.

A recreational activity practiced by some individuals is ignition of one's own flatus. This is performed by using a lit match or candle, or a cigarette lighter. So widespread is this activity that there are web sites on the Internet devoted exclusively to explaining proper lighting techniques.

A major drawback of this popular practice is that it usually involves the hazardous coupling of fire, combustible gases and inebriated participants. Reports of serious burns to body parts are not uncommon, this being especially true when the participants remove their clothing.

References:

1. Bouchier, I. A. D. (1980) The Practitioner, 224;373–377. Modification, Garland Publishing, Inc. N.Y.
2. Danhof, I. E. (1968) Ann. N. Y. Acad. Sci. 150;127–140.
3. Danzl, D. F. (1992) J. Emerg. Med., 10(1);79–88.
4. Fardy, J. and Sullivan, S. (1988) CMAJ, 139(12) ;1137–1142.
5. Friedman, G. (1991) Gastroenterol. Clin. North Am. 20(2); 313–324.
6. Levitt, M. D. (1971) New Engl. J. Med., 284;1394–1398.
7. Levitt, M. D. and Bond, J. H. (1978) in Intestinal Gas and Gastrointestinal Disease, J. S.
8. Polish, E. and Kadish, U. (1968) Ann. N. Y. Acad. Sci., 150;67–74.
9. Price, K. R., Lewis, J., Wyatt, G. M. and Fenwick, G. R. (1988) Nahrung, 32(6);609–626.
10. Rider, J. A. and Moeller, H. C. (1960) JAMA, 174;2052–2054.
11. Van Ness, M. M. and Cattau, E. L. (1985) Am. Fam. Practioner, 31;198–208.

SUMMARY OF INVENTION

In view of the foregoing, the main object of this invention is to provide a safe toy which exploits the combustible properties of flatus to fire a toy missile into space.

More particularly an object of this invention is to provide a toy gas-fired missile and launcher assembly collect in a combustion chamber an explosive mixture derived from a colonic mixture emanating from the operator of the toy.

Among the significant features of the invention are the following:

A. the toy assembly includes a hand-held unitary launcher.

B. Little skill and minimal safety precautions are required to operate the launcher; hence the operator may even be a child.

C. While the assembly explodes a mixture of air and colonic gas, it is hazard-free, for the explosive is safely confined.

Briefly stated, these objects are attained by a toy gas-fired missile and launcher assembly whose missile is composed of a soft head and a tail extending therefrom formed by a cylindrical piston. The piston is telescoped to the cylindrical barrel of a launcher having a closed end on which is mounted an electrically-activated ignitor, the air space between the end of the piston and the end of the barrel defining a combustion chamber. Joined to the barrel and communicating with the chamber therein is a gas intake tube having a normally-closed inlet valve.

To operate the assembly, the player who may be fully clothed places the inlet of the tube with its valve open adjacent his anal region from which a colonic gas is discharged. The piston is then withdrawn to a degree producing a negative pressure to inhale the gas into the combustion chamber to intermix with the air therein to create a combustible mixture. The ignitor is then activated to explode the gas in the chamber and fire the missile into space.

BRIEF DESCRIPTION OF DRAWINGS

For a better understanding of the invention, as well as other objects and features thereof, reference is made to the accompanying drawings wherein.

DESCRIPTION OF INVENTION

Figure 1:
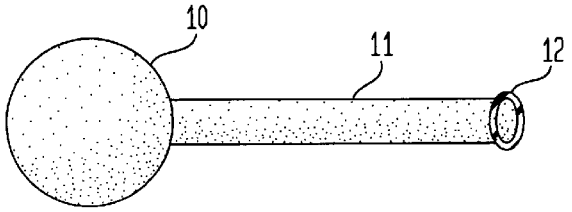
FIG. 1 illustrates the missile included in a toy-missile and launcher assembly in accordance with a preferred embodiment of the invention.

Referring now to FIG. 1, a toy missile for inclusion in a missile and launcher assembly in accordance with the invention is composed of a soft, spherical head 10 and a cylindrical tail 11 extending therefrom.

Head 10 is preferably in the form of a ball molded of open-cell flexible foam synthetic plastic material, such as polyurethane, whereby the ball is soft and compressible. The cylindrical tail 11 which functions as a plunger or piston is molded of light weight synthetic plastic material, such as closed-cell rigid foam plastic. The longitudinal axis of the piston is aligned with a diametrical axis of the ball. The missile is innocuous, for even if in flight the head of the missile strikes an individual, no injury will be inflicted thereby.

The launcher for the missile includes a cylindrical barrel 13 whose inner diameter is slightly larger than the diameter of the piston. Piston 11 which has an O-ring 12 mounted on its free end, telescopes within the barrel and is slidable therein. The O-ring which is formed of elastomeric material engages the inner surface of the barrel to effect a hermetic seal.

Cylindrical barrel 13 has an open mouth to receive the piston and a closed end wall 14 on which is centrally mounted an ignitor 15. Ignitor 15 preferably is in the form of a glow plug, this being a miniature electrical heating element of the type often used in an internal combustion engine to preheat the air in a cylinder to facilitate starting of the engine.

Joined to end wall 14 is a cylindrical battery casing 16 of the type used in flashlights, within which is housed a pair of dry cell batteries 17 and 18. These batteries are connected in series through a push-button switch 19 and a conductor 20 to the heater of ignitor element 15. The casing 16 is provided with a screw-on or removable cap 21 whereby the batteries may be replaced when they are exhausted.

When piston 11 of the missile is fully inserted in barrel 13 of the launcher, the free end of the piston is then spaced from end wall 14 to define a combustion chamber CC. Joined to barrel 13 and communicating with combustion chamber CC is a gas intake tube 22 which extends laterally from the barrel. Disposed in the inlet end of intake tube 22 is a manually-operated intake valve 23 having an actuator button 24 mounted on a spring-biased stem. When button 24 is depressed, the normally-closed valve is opened to permit intake of a gas. A suitable valve for this purpose is a one-way poppet check valve. Surrounding intake tube 22 is a cylindrical handle 25 having a corrugated surface to provide a good grip.

Method of Operation:

The missile of the assembly is launched into space when a mixture of colonic gas and air in the combustion chamber is ignited by ignitor 15. The resultant explosion acts to eject the piston from the barrel 13 of the launcher.

In operating the assembly, the player presses open intake valve 23 and places the inlet of intake tube 22 against the clothing covering his anal region. (In the specification, the terms operator and player are interchangeable.)

The player, as he discharges colonic gas into his anal region, concurrently grasps head 10 of the missile to pull out plunger 11 from the launcher barrel to an extent creating a negative pressure. This acts to draw the colonic gas through the intake tube 22 into combustion chamber CC where it is intermingled with air therein to produce a combustible mixture. Valve 23 is then closed to seal the combustible mixture in the chamber. In practice, the player or operator may be fully clothed, for the colonic gas passes through clothing which is permeable to gas.

Now the operator grasping the handle 25, aims the launcher in any desired direction, being careful however to avoid individuals, animals or breakable objects. The operator then fires the launcher by pressing the ignitor switch 19.

Figure 4:
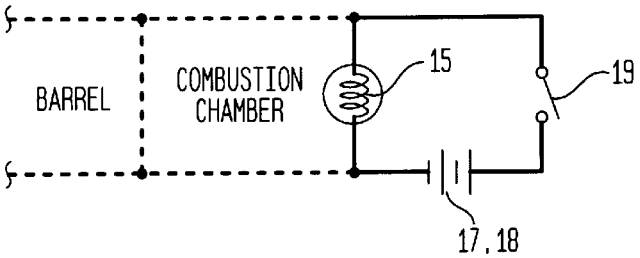
FIG. 4 is a schematic diagram of the electrical circuit of the assembly.

As shown in FIG. 4, when switch 19 is closed, the voltage from the serially-connected batteries 17 and 19 is applied across the resistance element of ignitor 15, causing this element to glow and ignite the explosive mixture. The resultant expansion of gases within combustion chamber CC produces a powerful force propelling the missile into space.

To reload the launcher, valve 23 is opened and piston 11 is reinserted in the barrel of the launcher, the advancing piston expelling air from the combustion chamber which is exhausted from the intake tube.

Figure 2:
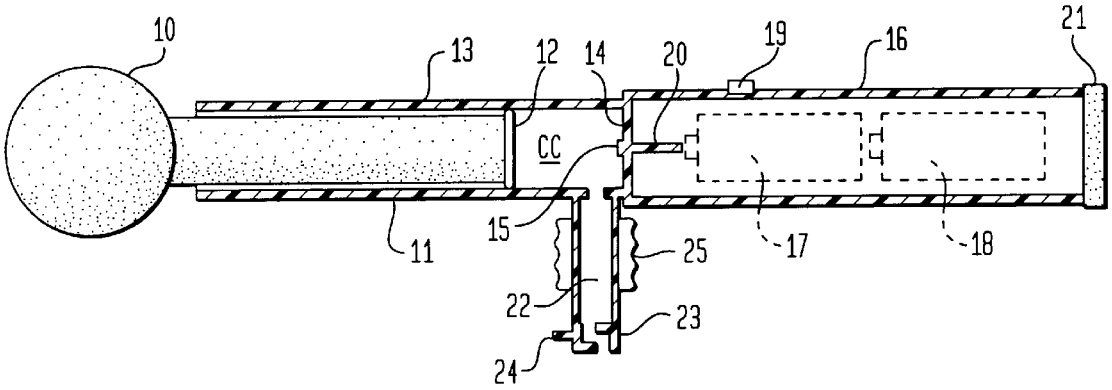
FIG. 2 is a longitudinal section taken through the assembly.
Figure 3:
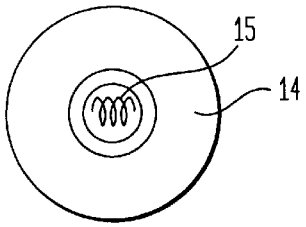
FIG. 3 is a plan view of the end wall in the barrel of the assembly.

In FIG. 2, the configuration of the launcher is dictated by the cylindrical battery casing 16 which is mounted behind the cylindrical barrel 13 in line therewith. In practice, the battery casing may be supported above the barrel in parallel relation thereto to provide a more compact launcher. Or use may be made of a single battery in a rectangular block form and a like-shaped case therefor; in which event the launcher will have a different configuration.

And it is not necessary that the intake tube have an inlet at right angles to the axis of the launcher barrel, for the inlet may be behind the barrel. The energy produced by an explosion of bowel gases need not be used to launch a toy missile but can be otherwise exploited, such as to project a flag from the barrel.

While there has been shown a preferred embodiment of a toy gas-fired missile and launcher assembly, it is to be understood that many changes may be made therein without departing from the spirit of the invention. Thus the intake tube may be hinged to the barrel so that when not in use it lies flat against the barrel.

We claim:

1. A toy gas-fired missile and launcher assembly for use by a human operator comprising:

A. a missile composed of a head and a piston extending axially from the head;

B. a barrel for launching the missile whose piston is telescoped in the barrel, a negative pressure being produced when the piston is pulled out, said barrel having a closed end in which is mounted an electrically-activatable ignitor, a combustion chamber being defined between said closed end of the barrel and an end of the piston when it is fully inserted in the barrel;

C. Means to feed a combustible gas mixture into said chamber, including an intake tube communicating with said chamber and having a normally-closed valve and an inlet to the tube, the inlet of the intake tube being placeable adjacent an anal region of the operator from which colonic gas is emitted whereby when the piston is pulled out the resultant negative pressure acts to inhale the colonic gas into said chamber to produce the combustible gas mixture; and D. means to apply an activating voltage to said ignitor to explode said mixture, thereby launching the missile.

2. An assembly as set forth in claim 1, in which the piston is cylindrical and is received in the barrel which is cylindrical.

3. An assembly as set forth in claim 1, in which said head is formed by a ball of flexible open-cell foam plastic material.

4. An assembly as set forth in claim 2, in which the foam plastic is urethane.

5. An assembly as set forth in claim 1, in which said ignitor is a glowplug.

6. An assembly as set forth in claim 5, in which said means to apply said voltage includes a casing mounted behind the end wall of the barrel and containing batteries and a switch mounted on the casing which when closed connects the batteries to the ignitor.

7. An assembly as set forth in claim 1, in which the intake tube is joined to the barrel and extends laterally therefrom.

8. An assembly as set forth in claim 7, in which the intake tube is hinged to the barrel and when not in use lies against the barrel.

9. An assembly as set forth in claim 1, in which intake tube is surrounded by a handle.

* * * * *